US006106490A

United States Patent [19]

Shaw

[11] Patent Number: 6,106,490

[45] **Date of Patent: *Aug. 22, 2000**

[54] TORSO EXERCISE AND TRACTION MACHINE WITH VIBRATIONAL THERAPY PADS

[76] Inventor: George B. Shaw, 8071 E. Del Trigo, Scottsdale, Ariz. 85258

[ * ] Notice: This patent is subject to a terminal disclaimer.

[21] Appl. No.: 09/356,103

[22] Filed: Jul. 16, 1999

[51] Int. Cl.[7] ..... A61H 1/00

[52] U.S. Cl. ..... 601/49; 601/24; 601/39; 601/56; 482/142; 482/907

[58] Field of Search ..... 601/24, 39, 49, 601/56, 57–60; 482/142, 907

[56] References Cited

U.S. PATENT DOCUMENTS

| | | | |
|---|---|---|---|
| 2,893,380 | 7/1959 | Walker et al. | 601/24 |
| 3,052,235 | 9/1962 | Stewart | 601/56 |
| 3,203,415 | 8/1965 | Moore | 601/56 |
| 3,550,587 | 12/1970 | Kawada | 601/61 |
| 3,835,844 | 9/1974 | Lang | 601/49 |
| 5,135,537 | 8/1992 | Lamb | 601/58 |
| 5,702,333 | 12/1997 | Waldron et al. . | |
| 5,713,832 | 2/1998 | Jain . | |
| 5,716,331 | 2/1998 | Chang . | |
| 5,730,706 | 3/1998 | Garnies . | |
| 5,792,082 | 8/1998 | Yamanaka et al. . | |
| 5,971,901 | 10/1999 | Shaw | 482/142 |

*Primary Examiner*—John Mulcahy
*Assistant Examiner*—Victor Hwang
*Attorney, Agent, or Firm*—Ellis, Venable & Busam LLP

[57] ABSTRACT

An exercise and rehabilitation machine for strengthening the torso muscles and rehabilitating back injuries includes an optional leg support and an angled torso platform further having attached a plurality of vibrational therapy pads and body pads whereby the angled torso platform cradles and supports that portion of weight attributable to the upper body, or torso, of a user, and if the leg support is not used, the user supports that portion of weight attributable to the lower body with the user's feet against the bottom surface of a room, or otherwise, if the leg support is included, the user supports that portion of weight attributable to the lower body with the user's legs draped over the leg support.

18 Claims, 7 Drawing Sheets

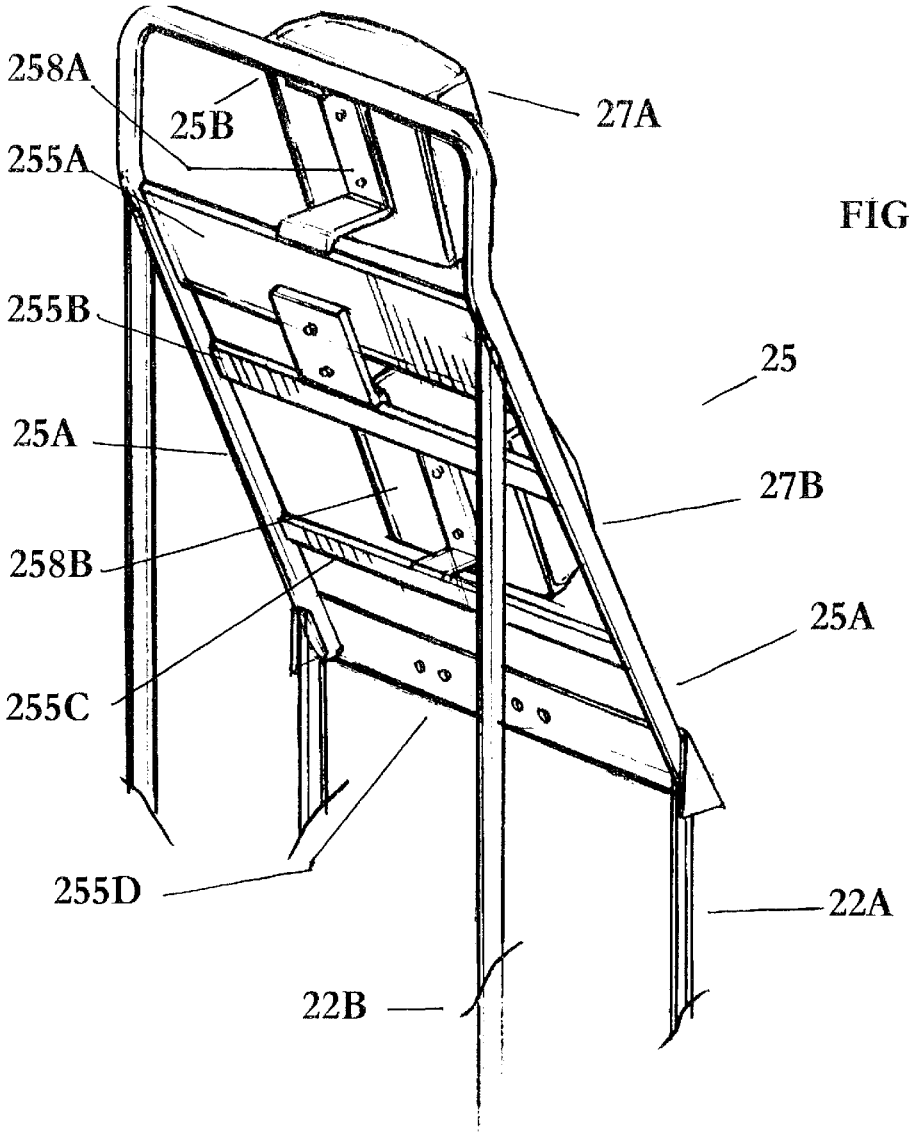
FIG. 11
FIG. 12
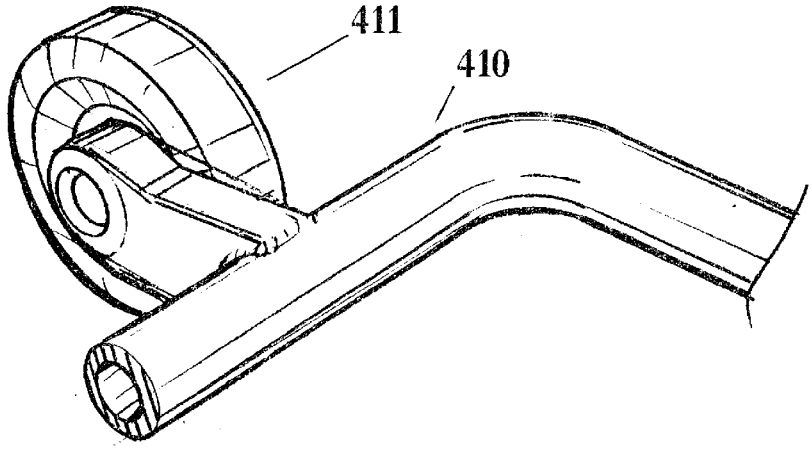

TORSO EXERCISE AND TRACTION MACHINE WITH VIBRATIONAL THERAPY PADS

FIELD OF THE INVENTION

The present invention relates to the field of exercise machines. More particularly, the present invention relates to the field of torso traction machines. Still more particularly, the present invention relates to the field of therapy exercise and traction machines that include vibrating therapy pads.

BACKGROUND

A common complaint among individuals is lower back pain. Frequently, the pain results from relatively weak lower back muscle strength or reduced blood circulation to the afflicted area of the body. Vibratory massage is one method currently used to alleviate lower back pain. Typically, a device for creating a vibratory sensation is placed inside of a chair or a cushion. The user then sits upon the chair or leans upon the cushion and turns on the vibratory device. For examples of such vibratory therapy devices see U.S. Pat. Nos: 2,715,901; 3,678,923; 3,948,379; 4,006,739; 4,971,040 and 5,022,384. For the most part, vibratory therapy devices have been used as passive therapy systems.

More proactive back therapy systems have been devised and are found in the prior art. These devices fall in two classifications: first, systems which utilizes kinesthetics to reduce lower back pain; and second, systems in which the user actively stretches and exercises muscles, thus strengthening and improving muscle tone.

In the first classification, kinesthetic treatment, the proactive therapy system places the user into a work position that reduces any stress and strain upon the lower back. Kinesthetic devices are designed to be used during a workers normal work routine. They serve to reduce problems causing lower back pain and not treat and/or strengthen the muscles of the lower back. An example of a kinesthetic device is found in U.S. Pat. No. 5,487,590 by Haynes.

In the second classification, active exercising devices, body movement is coupled with body placement to perform muscle stretching and exercising. A first example of a back exercise apparatus is found in U.S. Pat. No. 5,070,863 by McArthur et al. which provides an exercise device with two separate rotation axes for back therapy. There is a first vertical axis, generally aligned with the users spine, about which the user twists and turns, and there is a second horizontal axis, perpendicular to the first axis, about which the user can perform back flexion and extension exercises. This device utilizes well known exercises to provide therapy for lower back pain.

A second example of a back therapy system is found in U.S. Pat. No. 5,217,487 by Engle et al. Engle et al. which provides a back therapy device using a pivotable pelvic support. The user lies on the pelvic support, either facedown or face-up, and performs stretches and exercises. The pelvic support is positioned primarily under the user's center of gravity. However, this device provides a foot rest that is used to stabilize the user when he displaces his center of gravity slightly.

There is a third example of a back therapy system, found in U.S. Pat. No. 5,496,247, by Anderson, which provides a bench type apparatus with a plurality of belts used to anchor the lower portion of the body into place. Once the lower body is anchored into place the lower back muscles are isolated and may be more efficiently exercised.

While the above examples of back therapy devices are useful, none of the known prior art teaches, nor suggests, a device which incorporates both the features and benefits of a passive vibratory system with the features and benefits of an active, exercise oriented, system. Nor does the above prior art provide a device which utilizes gravity to create a gentle tension on the lower back for improved stretching and exercise.

SUMMARY OF THE INVENTION

It is an object of the present invention to provide an exercise machine useful for conditioning the lower back.

It is another object of the present invention to provide an exercise machine which incorporates a vibratory device into an active exercise device.

It is a further object of the present invention to provide an exercise machine which utilizes tension to aid in the therapy of lower back pain.

It is yet another object of the present invention to provide an exercise machine wherein the user is suspended from the machine at a first fixed position near the shoulders, and at a second fixed position, near the knees, whereupon the force of gravity upon the body creates a tension between the two fixed points to gently stretch lower back muscles and provides relief to lower back pain.

It is still yet another object of the present invention to provide an exercise machine wherein the user is suspended from two fixed points, thus using gravity to create a gentle tension on the back, and includes a vibratory device to stimulate blood circulation and muscle tone.

BRIEF DESCRIPTION OF THE DRAWINGS

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings wherein:

FIG. 11 depicts a rear perspective of the angled torso platform of the machine.

FIG. 12 depicts a wheel attached to the torso pedestal or the leg support pedestal that enables movement of the machine.

DESCRIPTION OF PREFERRED EMBODIMENTS

Figure 1:
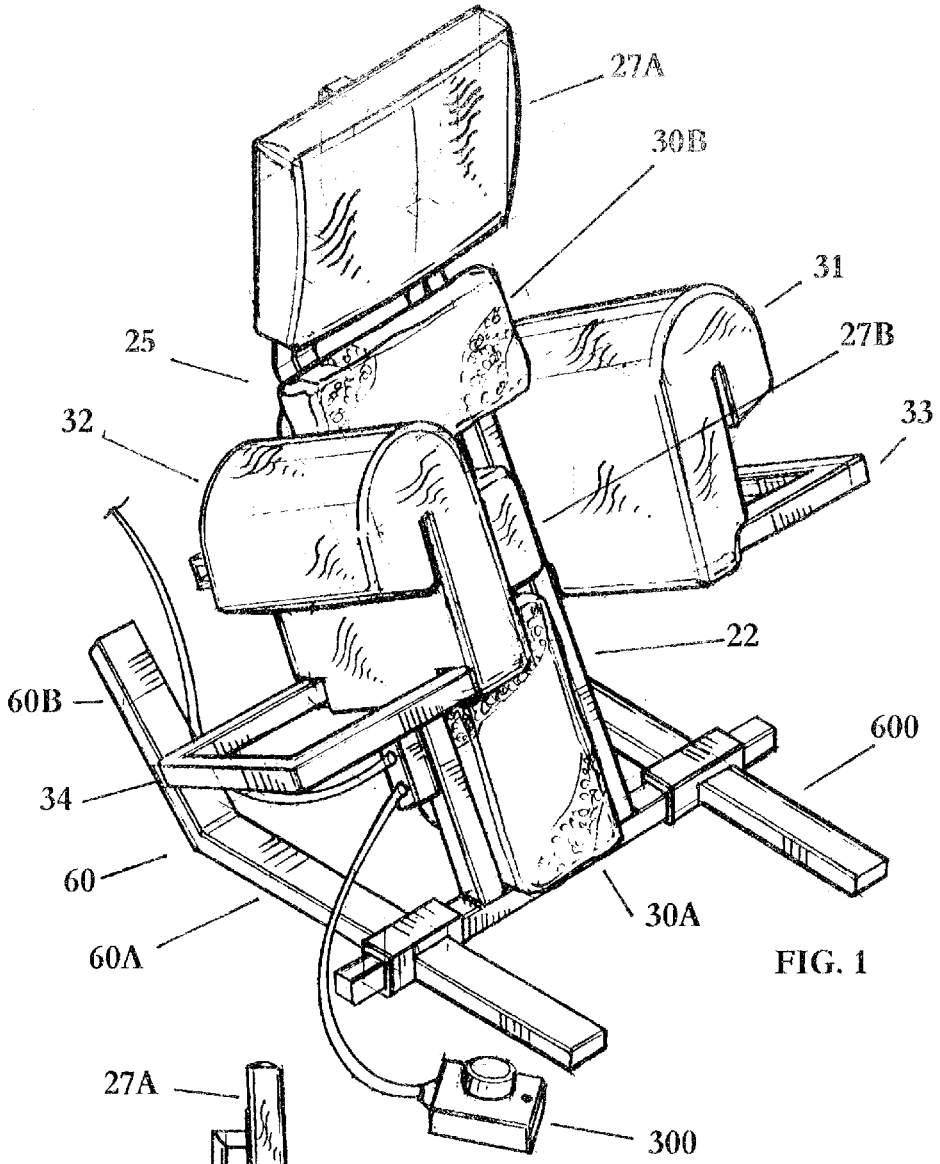
FIG. 1 depicts a plan view of the exercise machine without the optional leg support.

It is known that the susceptibility to back injuries can be lessened by stretching and strengthening the muscles of the hip, back, and abdominal region, which support the spine. Moreover, the pain of back injuries can eased by treatment with vibrating pads. Therefore, the present invention, a torso exercise and traction machine with vibrating therapy pads 1, is useful to prevent back injuries and rehabilitate back injuries.

Generally, the machine 1 of the present invention comprises an angled torso platform 25, at least one vertical upright 22, an optional leg support 40, and a base 60. The angled torso platform 25 further comprises, at least one but preferably, a plurality of attached vibrational therapy pads 30 and body pads 27, and is connected to said base 60 by the at least one vertical upright 22. An optional leg support 40 can also be directly coupled to the base 60.

Figure 3:
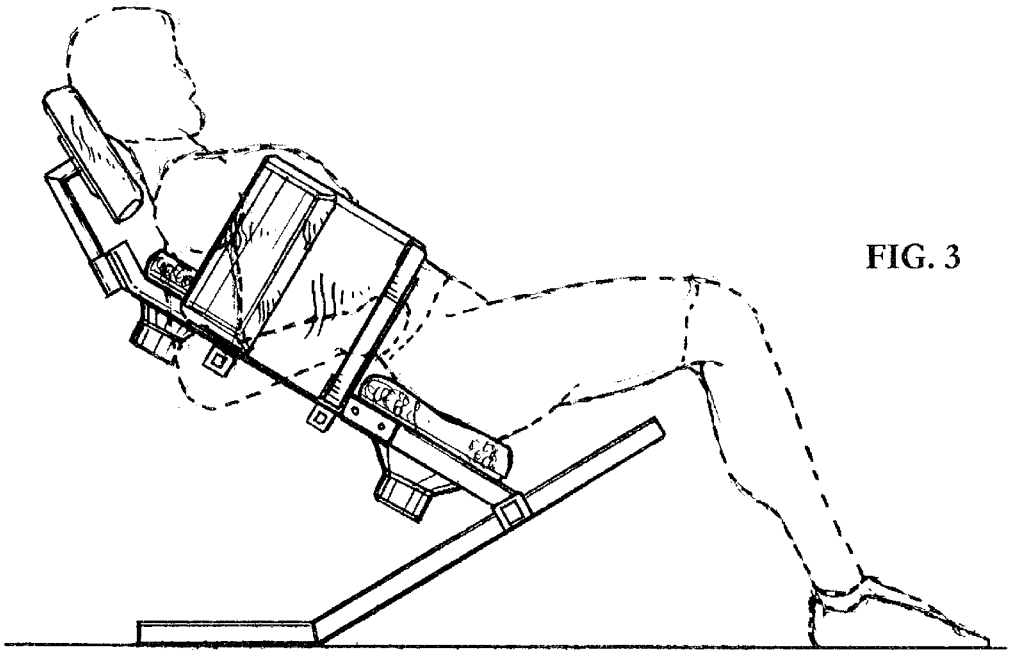
FIG. 3 depicts a side view of a user leaning backward in the exercise machine without the optional leg support.
Figure 4:
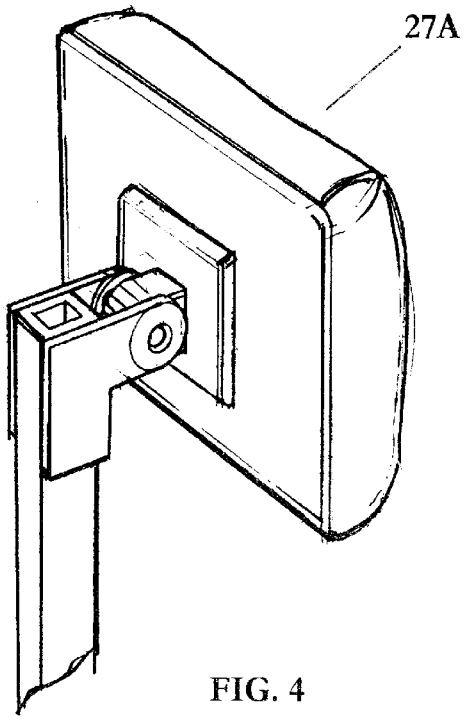
FIG. 4 depicts the headrest of the exercise machine.
Figure 5:
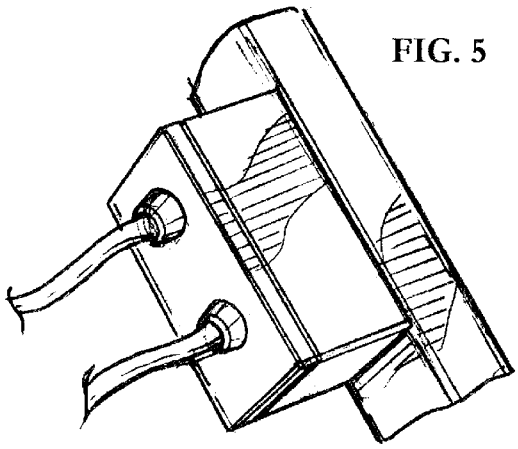
FIG. 5 depicts the electrical junction box of the exercise machine.
Figure 6:
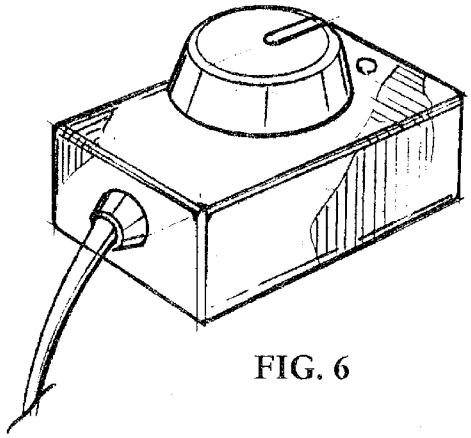
FIG. 6 depicts the adjustable vibrational therapy controller of the exercise machine.
Figure 10:
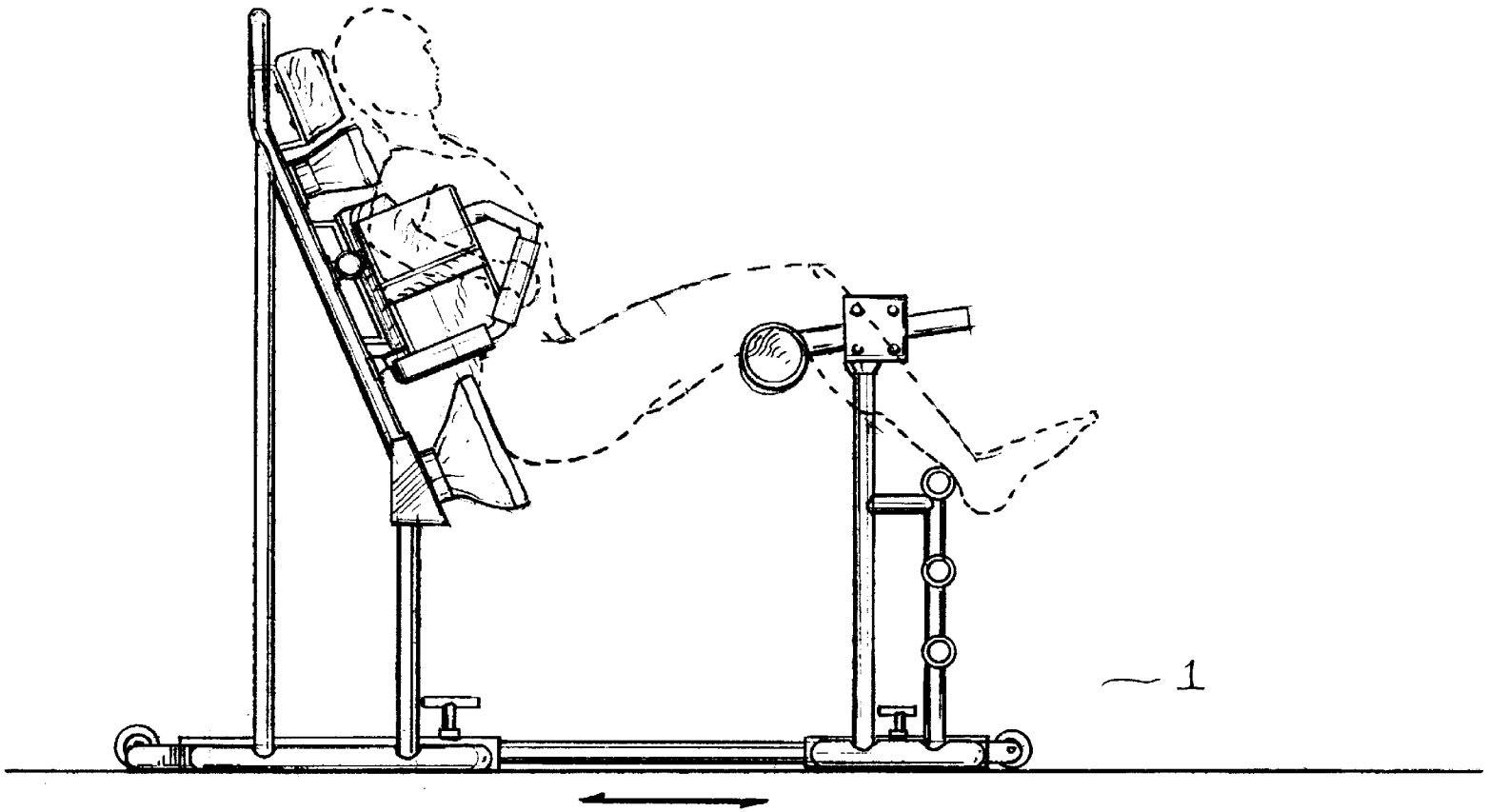
FIG. 10 depicts a side view of a user in the exercise machine using the optional leg support wherein the base of the machine is an adjustable support linkage.

While the machine 1 of the present invention can either be used with or without the optional leg support 40, in either case, the angled torso platform 25 cradles and supports that portion of weight attributable to the upper body, or torso, of a user. If the machine 1 is to be used without the leg support 40, the user supports that portion of weight attributable to the lower body with the user's feet against the bottom surface of a room as depicted in FIG. 3. Otherwise, if the leg support 40 is to be used, the user supports that portion of weight attributable to the lower body with the user's legs draped over the leg support 40 as depicted in FIG. 10.

Figure 2:
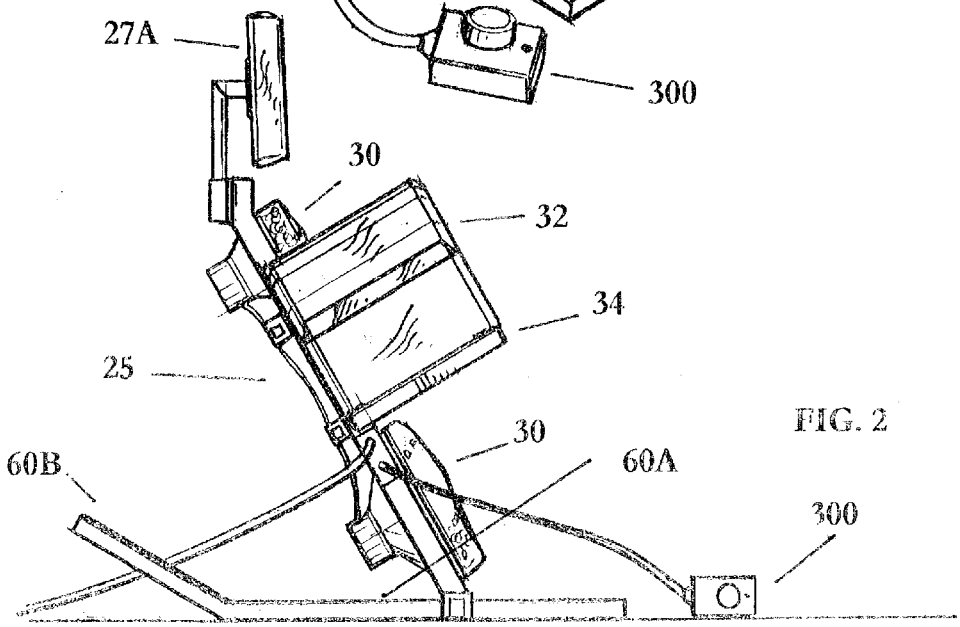
FIG. 2 depicts a side view of the exercise machine without the optional leg support.

In the preferred embodiment of the machine 1, the optional leg support 40 is not included and the angled torso platform 25 is reclinable between at least two angles. Moreover, left and right handlebars, 33 and 34 respectively, and left and right inverted "J" shaped shoulder joint pads, 31 and 32 respectively, are provided so that a user may brace their positioning against the angled torso platform 25. Further, at least one vibrational therapy pad 30 with a control switch 300 and at least one body pad 27 are provided for massage therapy and for comfort respectively. See FIG. 1. The angled torso platform can be made reclinable between at least two angles by any manner ordinary in the art for making reclining chairs. However, in the preferred machine the angled torso platform 25 is made reclinable by the base 60 depicted in FIGS. 1 and 2.

In the preferred embodiment, the angled torso platform 25 is connected by the at least one vertical upright 22 to the base 60, said base 60 further comprising at least one rocker 600. The rocker 600 of the base 60 is connected, such as by welding to said angled torso platform 25 by said at least one vertical upright 22, and constructed of at least two substantially flat segments, a first 60A and at least a second 60B respectively, connected at an angle of between five and thirty degrees. Normally, the first segment 60A is in contact with the bottom surface of a room. However, when said user pushes with his feet against the bottom surface of the room and leans backward against the angled torso platform 25, the second segment 60B comes into contact with the bottom surface of the room and prevents the user from toppling over backwards. See FIG. 3. Additionally, in the preferred embodiment, left and right inverted "J" shaped pads with laterally adjustable handlebars are included so that said user may brace their position against the angled torso pad. See FIG. 3.

Generally, the base 60 is the foundation of the machine and provides lateral and longitudinal support for the angled torso platform 25. However, if the optional leg support 40 is included, the base 60 also provides the foundation for the leg support 40 as well as the angled torso platform 25. Moreover, the machine 1 is adjustable for the proper length between the angled torso platform 25 and the leg support 40 so that the lower back region of the user drapes between, and is untouched by, the angled torso platform 25 and the leg support 40. This adjustment enables the user to isolate, stretch and strengthen the muscles of the hip, lower back, and abdominal region.

Figure 7:
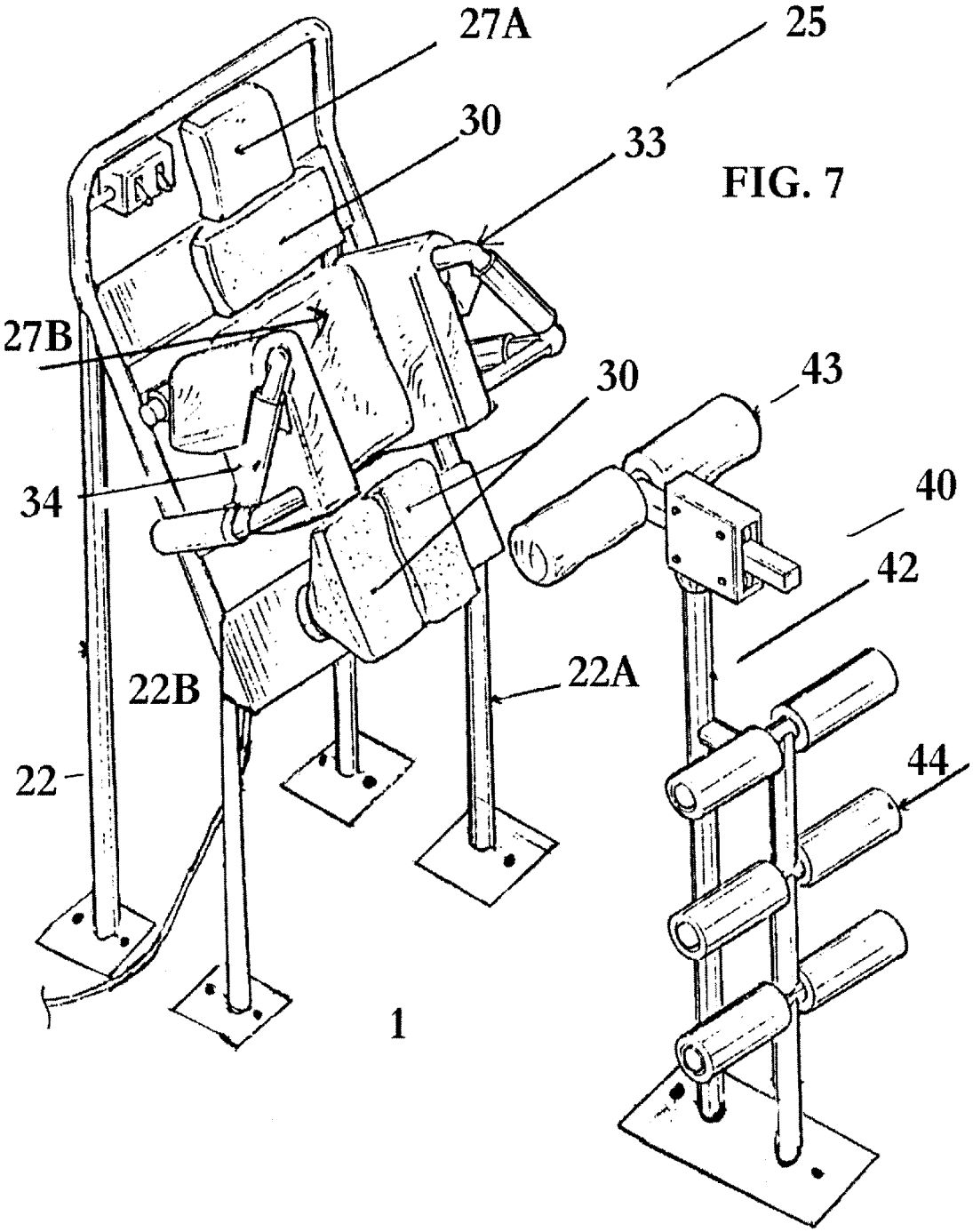
FIG. 7 depicts the exercise machine using the optional leg support wherein the base of the machine is the bottom surface of a room.
Figure 9:
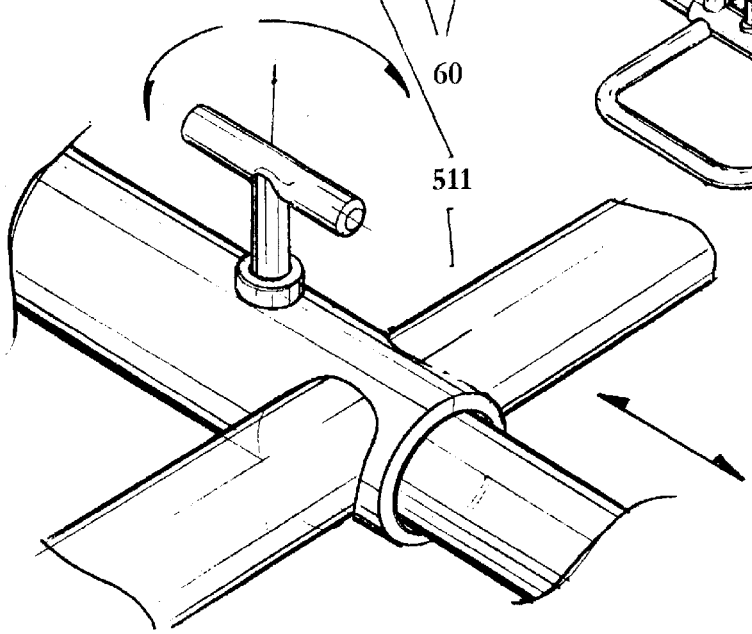
FIG. 9 depicts the telescoping connection of the exercise machine.

In a non-preferred embodiment of the machine, the leg support 40 is included as described below. See FIGS. 7 & 9. In such an embodiment of the machine 1, the base 60 is the floor or the bottom surface of any room. Therefore, the at least one vertical upright 22 and said leg support 40 are coupled to the floor by bolts or by other means ordinary in the art. This embodiment is depicted in FIG. 7.

Alternatively, in slightly different version of this embodiment, either the vertical upright 22 or the leg support 40 may be attached to the floor by a fixable adjustable track that permits relative longitudinal movement between the vertical upright 22 and the leg support 40. The construction of said fixable adjustable track is considered to be within the knowledge of one ordinarily skilled in the art.

In another embodiment of the machine 1 including the optional leg support 40, the base 60 comprises a torso pedestal 21, a leg support pedestal 41, and a longitudinally adjustable support linkage 50. In this embodiment, the torso pedestal 21 is coupled to the at least one vertical support 22 and the leg support pedestal 41 is coupled to said leg support 40. Said leg torso pedestal 21 and said leg support pedestal 41 are coupled together by said adjustable support linkage 50. The structures of the leg support pedestal 41 and the torso pedestal 21 are both substantially square perimeters constructed of one-inch diameter metal tubing. However, since the main consideration for the leg support pedestal 41 is sufficient structural integrity to withstand the weight of a user's legs, it is considered within the knowledge of an ordinarily skilled practitioner that other shapes could be used for the torso pedestal 21 and the leg support pedestal 41

Preferably, the linkage 50 comprises a tubular section 51 and at least one telescoping connection 511 at a first distal end of said tubular section 51 to said torso pedestal 21. The tubular section 51 extends outward longitudinally in front of the torso pedestal 21 connecting to said leg support pedestal 41 at a second distal end to the leg support pedestal 41 at a second optional telescoping connection 511.

The optional leg support 40 of the exercise and traction machine 1 comprises at least one leg support column 42, having at least one, but preferably two knee joint pads 43, and a plurality of left and right foot rungs 44. In one embodiment, the column 42 of the leg support 40 comprises an inverted "T" of one-inch metal tubing that connects to the leg support pedestal 41 and extends upward. Plus, three pairs of foot rungs 44 connect to the support column 42 and resemble ladder rungs.

The three pairs of foot rungs 44 are positioned, one quarter, one-half, and three quarters respectively, of the distance from the base 41 to where the at least one knee joint pad 43 is connected. Said foot rungs 44 preferably include foam padding for comfort and traction for a person climbing said foot rungs 44. Finally, at least one wheel 411 is attached to the front tube 410 of the leg support pedestal 41. Said wheel 411 can be attached in a slightly elevated position so that the leg support 40 must be angled or tipped to engage the wheels 411 of the support base 41 against the floor.

In use, the user drapes his legs over the at least one knee joint pad 43 and thereby supports his lower body weight. In this embodiment of the exercise machine 1, the bottom of the inverted "T" of said column 42 is adapted to receive the second distal end of the tubular section 51 of the adjustable support linkage 50.

The torso pedestal 21 of the base 60 is constructed from three quarter inch metal tubing having a perimeter that is substantially square. However, it is contemplated that other shapes, such as a ring or a rectangle, and that alternate sized tubing could be used to construct the pedestal 21 if the structural shape and the integrity of the tubing is strong enough to withstand the weight of the heaviest individual that may use the exercise and traction machine 1. To facilitate movement of the torso pedestal 21 and the angled torso platform 25, at least one wheel 411 is attached to the back tube of the pedestal 21. The wheel 411 can also be slightly elevated so that the torso pedestal 21 and the angled torso platform 25 must be angled or tipped to engage the wheel 411 of the pedestal 21 against the floor.

Connected between the preferred torso pedestal 21 of the base 60 and the angled torso platform 25 is the at least one vertical upright 22. Four vertical uprights 22 are preferred in this embodiment. More specifically, two front vertical uprights 22A and two rear vertical uprights 22B are connected at first distal ends to each corner of the torso pedestal 21. The second distal ends of the two front vertical uprights 22A and the two rear vertical uprights 22B are connected to the angled torso platform 25. Moreover, the front vertical uprights 22A are substantially equal in length and approximately one-half the length of the rear vertical uprights 22B that are substantially equal in length to each other. Whereas any material strong enough to support the weight of an individual can be used for the preferred vertical uprights, 22A and 22B, the preferred material of construction is three-quarter inch metal tubing.

An inverted substantially "U-shaped" frame comprises the preferred angled torso platform 25 of the exercise and traction machine 1. The "U-shaped" frame of the angled torso platform 25 is preferably constructed of three-quarter inch metal tubing wherein the cross sectional area between parallel substantially vertically oriented side tubing 25A of the "U-shaped" frame is larger than an average individual's back. For instance, a "U-shaped" frame width that measures two and one-half feet wide between the parallel vertically oriented side tubing 25A of the angled torso platform 25 should suffice. Moreover, a "U-shaped" frame length that measures three and one-half feet long from the transverse tube 25B of the "U-shaped" frame to the ends of the vertically oriented side tubing 251 of the angled torso platform 25 should suffice. See FIG. 11.

The torso platform 25 is positioned substantially angled to the floor. While any angle greater than approximately twenty degrees is contemplated, the preferred angle of the angled torso platform substantially approximates forty-five degrees. Generally, the lengths of the front vertical uprights 22A relative to the two rear vertical uprights 22B determines the angle of the torso platform 25. Therefore, the vertical uprights, 22A and 22B, can comprise independently adjustable telescoping sections to enable varied angled torso platform 25 angles (not shown). Said vertical uprights, 22A and 22B, can be made adjustable by any manner ordinary in the art such as using two sections of tubing with alternate diameters, wherein one section is adapted to receive the other the other section with a telescoping connection 511.

Finally, the preferred torso platform 25 of this embodiment includes at least one, but preferably four substantially flat metal brackets 255 that span the parallel vertically oriented side tubing 251 of the "U-shaped" frame 251. Moreover struts 258 connect between the brackets 255 and protrude beyond the hypothetical plane of the "U-shaped" frame 250 and the brackets 255. A first strut 258A connects between the transverse tube 25B of the "U-shaped" frame 251, and a first bracket 255A. A second strut 258B connects between said second bracket 255B and said third bracket 255C.

The brackets 255 and struts 258 are preferably constructed from flat quarter inch metal and have sufficient width to provide enough structural integrity to brace a body without bending. In one embodiment, the first bracket 255A was five inches wide, the second bracket 255B and the third bracket 255C were two inches wide, and the fouth bracket 255D was was four inches wide. The struts, 258A and 258B, were two inches wide.

The body pads 27 are attached removably to the torso platform 25 and enable comfortable use of the machine 1. The preferred body pads 27 are a headrest 27A and a thoracic spine region pad 27B. Still, the inventor contemplates that alternate or additional body pads 27 can be added to accommodate any particular need. Said headrest 27A is preferably removably attached to the first strut 258A, and the thoracic spine region pad 27B is preferably removably attached to said second strut 258B, both by means ordinary in the art such as nut and bolt. The body pads 27 are preferably comprised of padding typically used in the exercise machine industry. Such padding typically combines comfort and sufficient durability to sustain repeated use. Generally, vinyl over two-inch thick foam padding with a wood or plastic backing will suffice. The size of the headrest pad 27A should be substantially square having enough area to accommodate a user's head. An eight-inch length and width is contemplated to be sufficient. The size of the thoracic spine region pad 27B should be substantially square having enough area to accommodate a user's back. A six-inch length and width is contemplated to be sufficient.

The vibrational therapy pads 30 of the machine 1 are provided to add therapeutic massage to a machine 1 user. Said pads 30 can be off the shelf vibrating devices powered by alternating current that are removably attached to the torso platform 25 and positioned to provide vibratory massage to the back region targeted. At least one vibrational therapy pad 30 is provided. However, it is preferred that at least two lower vibrational pads 30A and one upper vibrational pad 30B are attached to the angled torso platform 25.

The lower vibrational pads 30A are preferably positioned to massage the muscles on both sides of the spine in the lumbar spine region of a user's back. The upper vibrational pads 30B are preferably positioned to massage the muscles on both sides of the spine in the cervical and thoracic spine regions of a user's back. Accordingly, the upper vibrational pads 30B are removably mounted to the first bracket 255A and the lower vibrational pads 30A are removably mounted to the fourth bracket 255D. Finally, the vibrational therapy pads 30 can also each include removable covers 29 that are soft fabric to enable easy cleaning and sanitary use for multiple users.

The angled torso platform 25 of the machine 1 further includes left and right handlebars, 33 and 34 respectively, that are mirror images of each other and are constructed of three-quarter inch metal cylindrical or square tubing. It is comtemplated that at least two different ways of contructing the handlebars 33 and 34, are possible. See FIGS. 1, 8 & 13. One constuction will be described below with the understanding that alternative constructions are possible.

Figure 8:
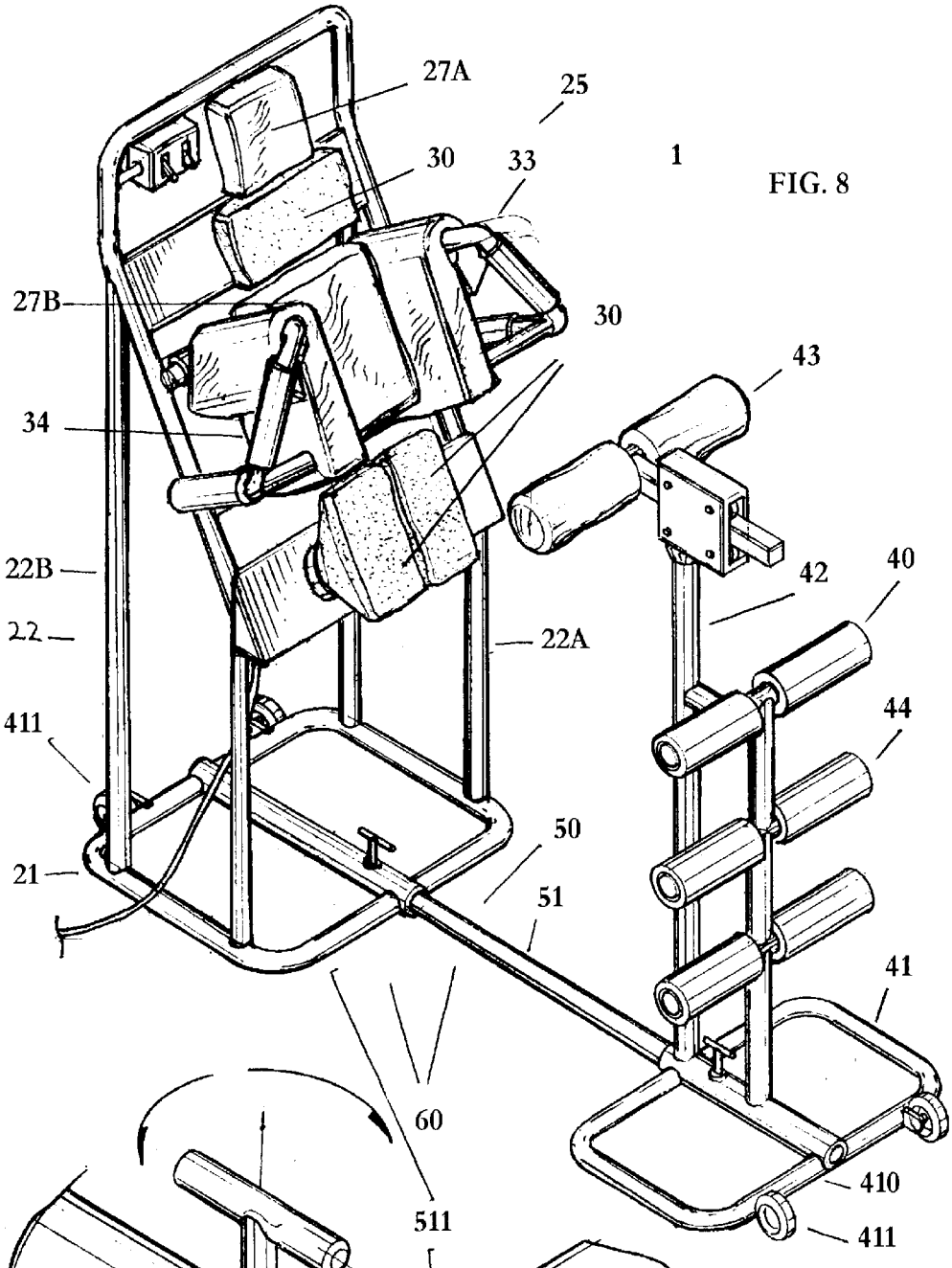
FIG. 8 depicts the exercise machine using the optional leg support wherein the base of the machine is an adjustable support linkage.
Figures 13, 14:
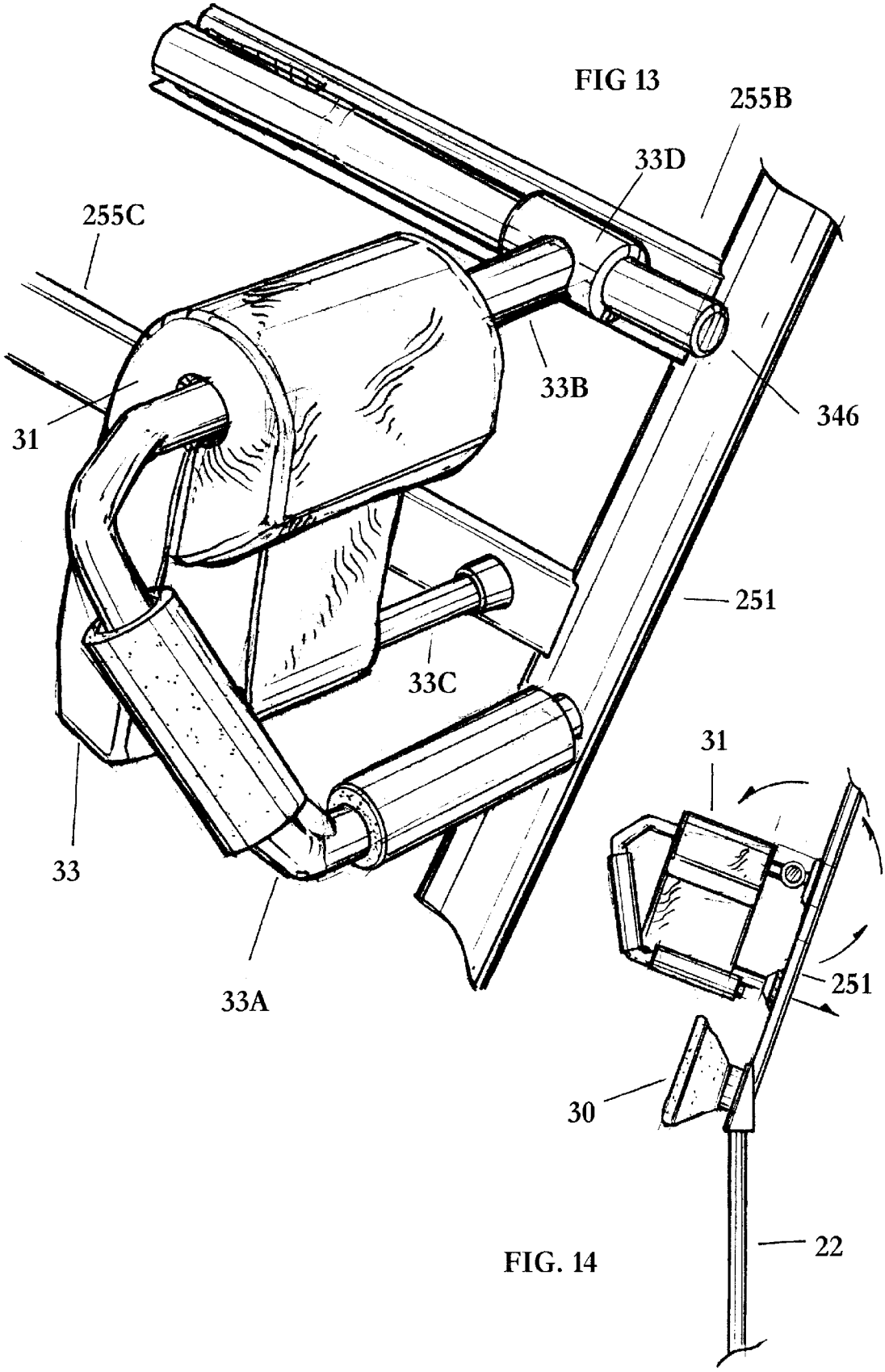
FIG. 13 depicts a perspective view of the left handlebar of the machine.
FIG. 14 depicts a side view of the left handlebar and the lower vibrational therapy pad attached to the angled torso platform.

In one embodiment depicted in FIG. 8 and 13, said handlebars, 33 and 34, each comprise first distal ends that are gripping sections, 33A and 34A, that are bent back into a "U" shape and connected at second distal ends to top brace sections, 33B and 34B, and bottom brace sections, 33C and 34C, at "Y" joints (not shown). Foam rubber padding is preferably included on the first distal ends that are gripping sections, 33A and 34A, of said handlebars, 33 and 34. Opposite said connected end of said top brace sections, 33B and 34B, cylindrical "T" rings, 33D and 34D, of metal tubing are connected at right angles to said top brace sections, 33B and 34B. Said "T" rings, 33D and 34D, enable the lateral adjustability of the left and right handlebars, 33 and 34 respectively, and attached shoulder joint pads, 31 and 32.

To enable lateral adjustability of said left and right handlebars, 33 and 34 respectively, connected at a medial position of said second bracket 255B of said preferred angled torso platform 25, is a horizontal "T" ring engaging tube 346 having left and right distal ends that is also connected at a medial position of said tube 346 to said bracket 255B. Said "T" rings, 33D and 34D, of said handlebars, 33 and 34, are adapted to receive said engaging tube 346 and slide laterally. Moreover, said handlebars are also constructed so that the distal ends of said bottom brace sections, 33C and 34C, contact said third bracket 255C of said torso platform 25 and supports said handlebars, 33 and 34, and accordingly, the user's weight thereupon.

Completing the torso platform 25 are a left shoulder joint pad 31 and a right shoulder joint pad 32 positioned on either side of the user of the machine 1. The shoulder joint pads, 31 and 32, are positioned to contact under the user's shoulder joints and provide padding while a user supports their weight using the large muscles of the back. Left and right handlebars, 33 and 34 respectively, are also provided on either side of the torso platform 25 so that a user may grip and steady their position on the machine 1. Further, said handlebars, 33 and 34, and attached shoulder joint pads, 31 and 32, adjust laterally for backs of alternate widths.

In the preferred embodiment of the exercise and traction machine 1, the shoulder joint pads, 31 and 32, are substantially inverted "J" shaped pads. The "J" shaped shoulder joint pads, 31 and 32, are preferably positioned perpendicular to, and on either side of, the thoracic spine region pad 27B. More particularly, the shoulder joint pads, 31 and 32, are turned so that the back of the shoulder joint pads, 31 and 32, face each other and fit beneath the shoulder joints of a user in the area typically referred to as the underarm. Finally, the left and right shoulder joint pads, 31 and 32 respectively, can be removably attached to the left handlebar 33 and the right handlebar 34 using standard attachment means such as snap-buttons or hook and loop fastener.

While these descriptions directly describe the above embodiments, it is understood that those skilled in the art may conceive modifications and/or variations to the specific embodiments shown and described herein. Any such modifications or variations that fall within the purview of this description are intended to be included therein as well. It is understood that the description herein is intended to be illustrative only and is not intended to be limitative. Rather, the scope of the invention described herein is limited only by the claims appended hereto.

What is claimed is:

1. An exercise and traction machine comprising:

a. a base;

b. an angled torso platform, said angled torso platform further comprising, i. at least one vibrational therapy pad coupled to said angled torso platform and positioned to engage the back of a user, ii. a laterally adjustable left handlebar attached to said angled torso platform at a position to be engaged beneath the left arm of a user and a left shoulder joint pad removably attached to said left handlebar at a position to engage beneath the left underarm of a user, iii. a laterally adjustable right handlebar attached to said angled torso platform at a position to be engaged beneath the right arm of a user and a right shoulder joint pad removably attached to said right handlebar at a position to engage beneath the right underarm of a user; and c. at least one vertical upright coupled between said base and said angled torso platform, whereby a user is supported on said angled torso platform by their engagement with said left and right shoulder joint pads so that a portion of their back contacts the at least one vibrational therapy pad to enable the user to stretch and strengthen the muscles of the hip, lower back, and abdominal region.

2. The exercise and traction machine of claim 1 wherein said angled torso platform is selectively reclined between at least two substantially static angles.

3. The exercise and traction machine of claim 1, wherein said base further comprises;

a. at least one rocker arm further comprised of at least two substantially flat segments, a first segment and at least a second segment, connected together at an angle, whereby said first segment normally contacts the bottom surface of a room and said at least second segment contacts the bottom surface of said room when a person leans backward against said angled torso platform.

4. The exercise and traction machine of claim 1 wherein said base is the bottom surface of any room.

5. The exercise and traction machine of claim 1 wherein said at least one vertical upright is connected to said base by a track to selectively permit longitudinal movement of said at least one vertical upright relative to said base.

6. The exercise and traction machine of claim 1 wherein said at least one vertical upright comprises four vertical uprights that are coupled between said base and said angled torso platform.

7. The exercise and traction machine of claim 1 wherein said angled torso platform is angled to the horizontal at an angle between twenty and seventy-five degrees.

8. The exercise and traction machine of claim 1 wherein said angled torso platform further comprises a plurality of removably attached body pads.

9. The exercise and traction machine of claim 8 wherein said plurality of removably attached body pads comprises a headrest and a thoracic spine region pad.

10. The exercise and traction machine of claim 1 wherein said at least one vibrational therapy pad comprises:

at least one upper vibrational therapy pad positioned to massage the muscles on both sides of the spine in the cervical and thoracic regions of a user's back, and at least one lower vibrational therapy pad positioned to massage the muscles on both sides of the spine in the lumbar region of a user's back.

11. The exercise and traction machine of claim 1 further comprising a leg support attached to said base.

12. The exercise and traction machine of claim 11, wherein said leg support further comprises; a leg support column further comprising, i. a plurality of pairs of left and right foot rungs, and ii. at least one pair of knee joint pads.

13. The exercise and traction machine of claim 11 wherein said leg support is coupled to said base by a selectively adjustable track that permits longitudinal movement of said leg support relative to said base.

14. The exercise and traction machine of claim 11 wherein said base further comprises, a. a torso support pedestal coupled to said at least one vertical upright, b. a leg support pedestal coupled to said leg support, and c. a longitudinally adjustable support linkage coupled between both said torso support pedestal and said leg support pedestal.

15. The exercise and traction machine of claim 14 wherein said longitudinally adjustable support linkage is a metal tube that is connected to said torso support pedestal and longitudinally adjustably attached to said leg support pedestal.

16. An exercise and traction machine comprising:

a. a support linkage;

b. an angled torso platform, said angled torso platform further comprising, i. a left handlebar laterally adjustably attached to said angled torso platform, a) a left shoulder joint pad removably attached to said left handlebar at a position to engage beneath the left underarm of a user, ii. a right handlebar laterally adjustably attached to said angled torso platform, a) a right shoulder joint pad removably attached to said right handlebar at a position to engage beneath the right underarm of a user, iii. at least one upper vibrational therapy pad removably attached to said angled torso platform and positioned to massage the muscles on both sides of the spine in the cervical and thoracic regions of a user's back, iv. at least one lower vibrational therapy pad removably attached to said angled torso platform and positioned to massage the muscles on both sides of the spine in the lumbar region of a user's back, and v. a plurality of body pads removably attached to said angled torso platform;

c. four vertical uprights coupled between said support linkage and said angled torso platform; and d. a leg support pedestal coupled to said support linkage, said leg support further comprising, i. a leg support pedestal, and ii. a leg support column fixedly connected to said leg support pedestal, said leg support column further comprising, a) a plurality of pairs of left and right foot rungs, and b) at least one pair of knee joint pads, whereby said exercise and traction machine enables a user to stretch and strengthen the muscles of the hip, lower back, and abdominal region by positioning their body on the machine so that their underarms are supported by the shoulder joint pads and their legs are supported by the leg support.

17. The exercise and traction machine of claim 16 wherein said left shoulder joint pad and said right shoulder joint pad are removably attached to said left handlebar and said right handlebar by hook and loop fastener.

18. The exercise and traction machine of claim 16 wherein said leg support pedestal further comprises at least one wheel attached to said leg support pedestal in a slightly elevated position so that the leg support pedestal must be angled to engage said at least one wheel against the bottom surface of any room.

* * * * *